US010502213B2

(12) United States Patent
Berlage et al.

(10) Patent No.: US 10,502,213 B2
(45) Date of Patent: Dec. 10, 2019

(54) ELECTRONICALLY-CONTROLLED COMPRESSED AIR SYSTEM

(71) Applicant: Caterpillar Global Mining Equipment LLC, Denison, TX (US)

(72) Inventors: Rick William Berlage, Washington, IL (US); Brian Daniel Rockwood, Washington, IL (US); Jerry E. Berkeland, Melissa, TX (US)

(73) Assignee: Caterpillar Global Mining Equipment LLC, Denison, TX (US)

( * ) Notice: Subject to any disclaimer, the term of this patent is extended or adjusted under 35 U.S.C. 154(b) by 321 days.

(21) Appl. No.: 15/379,881

(22) Filed: Dec. 15, 2016

(65) Prior Publication Data

US 2018/0172005 A1 Jun. 21, 2018

(51) Int. Cl.

| | |
|---|---|
| ***F04C 29/12*** | (2006.01) |
| ***F04C 28/24*** | (2006.01) |
| ***F04B 23/02*** | (2006.01) |
| ***F04D 15/00*** | (2006.01) |
| ***F15B 13/02*** | (2006.01) |

(Continued)

(52) U.S. Cl.

CPC ..... *F04C 29/124* (2013.01); *F04B 23/00* (2013.01); *F04B 23/02* (2013.01); *F04B 41/02* (2013.01); *F04C 18/16* (2013.01); *F04C 23/02* (2013.01); *F04C 28/24* (2013.01); *F04C 29/0085* (2013.01); *F04D 15/0083* (2013.01); *F15B 13/024* (2013.01); *F15B 2211/40515* (2013.01); *F15B 2211/50518* (2013.01); *Y10T 137/7761* (2015.04)

(58) Field of Classification Search

CPC ..... F15B 2211/50518; F15B 13/024; F15B 2211/40515; Y10T 137/7761; F04D 15/0083; F04C 28/24; F04C 29/124; F04B 41/02; F04B 23/02

See application file for complete search history.

(56) References Cited

U.S. PATENT DOCUMENTS

| | | | | |
|---|---|---|---|---|
| 5,265,547 | A | 11/1993 | Daws | |
| 6,533,552 | B2 * | 3/2003 | Centers | F04B 49/065 417/12 |

(Continued)

FOREIGN PATENT DOCUMENTS

| | | | |
|---|---|---|---|
| CN | 201209672 | Y | 3/2009 |
| CN | 201787090 | U | 4/2011 |

*Primary Examiner* — Atif H Chaudry

(74) *Attorney, Agent, or Firm* — Miller, Matthias & Hull

(57) ABSTRACT

A compressed air system may comprise an air compressor configured to generate compressed air, a reservoir configured to store the compressed air, a reservoir pressure sensor configured to monitor an actual reservoir pressure of the compressed air stored in the reservoir, an outlet valve configured to regulate a flow of the compressed air out of the reservoir, and an outlet electronic actuator configured to adjust a position of the outlet valve. The compressed air system may further comprise an electronic control module (ECM) configured to transmit a command to the outlet electronic actuator to cause the outlet electronic actuator to open the outlet valve when the actual reservoir pressure is above a target reservoir pressure, and transmit a command to the electronic actuator to cause the electronic actuator to close the outlet valve when the actual reservoir pressure is below the target reservoir pressure.

18 Claims, 7 Drawing Sheets

(51) Int. Cl.

| | |
|---|---|
| ***F04B 41/02*** | (2006.01) |
| ***F04C 18/16*** | (2006.01) |
| ***F04C 23/02*** | (2006.01) |
| ***F04C 29/00*** | (2006.01) |
| ***F04B 23/00*** | (2006.01) |

(56) References Cited

U.S. PATENT DOCUMENTS

| | | | | |
|---|---|---|---|---|
| 8,881,762 | B2 | 11/2014 | Johnson et al. | |
| 2007/0246262 | A1* | 10/2007 | Brookover | E21B 21/08 175/27 |
| 2010/0203819 | A1* | 8/2010 | Horner | B64D 13/04 454/74 |
| 2011/0255994 | A1* | 10/2011 | Field | F04B 49/022 417/53 |

* cited by examiner

ELECTRONICALLY-CONTROLLED COMPRESSED AIR SYSTEM

TECHNICAL FIELD

The present disclosure generally relates to compressed air systems and, more specifically, compressed air systems having electronically controlled valves.

BACKGROUND

Many machines and equipment include compressed air systems that provide compressed air to perform various functions. Such compressed air systems may include an air compressor that is driven by an engine of the machine, an inlet valve that regulates airflow to an inlet of the air compressor, and a reservoir that stores the compressed air generated by the air compressor. For example, drill machines (such as track drill machines), surface rock drills, and rotary drill machines may supply compressed air down a drill rod to flush dust out of a hole as the hole is being drilled by the drill rod. Such machines may also rely on compressed air to perform such functions, such as driving the flow of lubricating oil through the air compressor, and intermittently cleaning filters of a dust collector which collect the dust of the material that is flushed out of the hole. To perform such functions, compressed air may be directed to various downstream sites (e.g., the drill rod, the dust collector filter, etc.) from the reservoir.

The pressure of the compressed air in the reservoir may be carefully regulated to both support the downstream functions of the machine that rely on compressed air, and to prevent over pressurization of the reservoir. For instance, even when the inlet valve to the air compressor is closed, the reservoir may be continuously charged with compressed air due to leakage of air through one or more orifices of the inlet valve, possibly allowing excess pressure to build up in the reservoir. To avoid over pressurizing the reservoir, the compressed air system may include a pressure release valve, or a running blow down valve, that opens to allow release of the compressed air in the reservoir to the atmosphere when the machine is running. The outflow of the running blow down valve may be regulated by manual adjustment of the valve orifice size. In addition, a separate blow down valve of a fixed orifice size may allow the compressed air in the reservoir to escape to the atmosphere when the machine is turned off.

Tank pressure release through the running blow down valve may be relatively slow as it relies on outflow of compressed air through the fixed orifice of the valve to depressurize the reservoir to a desired level. Furthermore, during drilling, the running blow down valve may be open and allow compressed air, which could otherwise more effectively be delivered to the drill rod, to leak to the atmosphere. As a result, the efficiency of the compressed air system may be reduced, and power burdens on the engine may be needlessly increased. Moreover, the running blow down valve and the blow down valve may be pneumatically controlled through pneumatic actuators, such as pneumatic cylinders. In some circumstances, pneumatic control of the running blow down valve and the blow down valve may be inefficient, unreliable, and unstable.

U.S. Pat. No. 5,265,547 discloses an air drill that uses air to meter seeds to planter units. The air drill includes a butterfly valve for selectively diverting the seeds to one or both of two different planter units. A solenoid actuator is used to control a position of the butterfly valve. However, the patent does not mention strategies for regulating the pressure of compressed air stored in a compressed air reservoir. There is a need for improved control systems for regulating the pressure of compressed air reservoirs in machines having compressed air systems.

SUMMARY

In accordance with one aspect of the present disclosure, a compressed air system for a machine is disclosed. The compressed air system may comprise an air compressor configured to generate compressed air, a reservoir configured to store the compressed air generated by the air compressor, and a reservoir pressure sensor configured to monitor an actual reservoir pressure of the compressed air stored in the reservoir. The compressed air system may further comprise an outlet valve configured to regulate a flow of the compressed air out of the reservoir, and an outlet electronic actuator operatively associated with the outlet valve to adjust a position of the outlet valve. In addition, the compressed air system may further comprise an electronic control module (ECM) in electronic communication with the reservoir pressure sensor and the outlet electronic actuator. The ECM may be configured to transmit a command to the outlet electronic actuator to cause the outlet electronic actuator to at least partially open the outlet valve when the actual reservoir pressure is above the target reservoir pressure. The ECM may be further configured to transmit a command to the outlet electronic actuator to cause the outlet electronic actuator to close the outlet valve when the actual reservoir pressure is below the target reservoir pressure.

In accordance with another aspect of the present disclosure, a method for electronically controlling a pressure of compressed air stored in a reservoir of a compressed air system of a machine is disclosed. The reservoir may include an outlet valve configured to regulate a flow of the compressed air out of the reservoir. The method may comprise determining a pressure difference between an actual reservoir pressure of the compressed air stored in the reservoir and a target reservoir pressure. The actual reservoir pressure may be monitored by a reservoir pressure sensor. The method may further comprise transmitting a command to an outlet electronic actuator to cause the outlet electronic actuator to at least partially open the outlet valve when the actual reservoir pressure is above the target pressure, and transmitting a command to the outlet electronic actuator to cause the outlet electronic actuator to close the outlet valve when the actual reservoir pressure is below the target reservoir pressure.

In accordance with another aspect of the present disclosure, a machine is disclosed. The machine may comprise an internal combustion engine, an air compressor driven by the internal combustion engine and having an inlet, an inlet valve configured to regulate of a flow of air to the inlet, and an inlet electronic actuator configured to adjust a position of the inlet valve. The machine may further comprise a reservoir configured to store compressed air generated by the air compressor, a reservoir pressure sensor configured to monitor an actual reservoir pressure of the compressed air stored in the reservoir, an outlet valve configured to regulate a flow of the compressed air out of the reservoir, and an outlet electronic actuator configured to adjust a position of the outlet valve. In addition, the machine may further comprise an electronic control module (ECM) in electronic communication with the reservoir pressure sensor, the inlet electronic actuator, and the outlet electronic actuator. The ECM may be configured to transmit a positive command to the inlet electronic actuator and the outlet electronic actuator when the actual reservoir pressure is below a target reservoir pressure. The positive command may cause the inlet electronic actuator to at least partially open the inlet valve, and may cause the outlet electronic actuator to close the outlet valve. The ECM may be further configured to transmit a negative command to the inlet electronic actuator and the outlet electronic actuator when the actual reservoir pressure is above the target reservoir pressure. The negative command may cause the inlet electronic actuator to close the inlet valve, and may cause the outlet electronic actuator to at least partially open the outlet valve.

These and other aspects and features of the present disclosure will be more readily understood when read in conjunction with the accompanying drawings.

DETAILED DESCRIPTION

Figure 2:
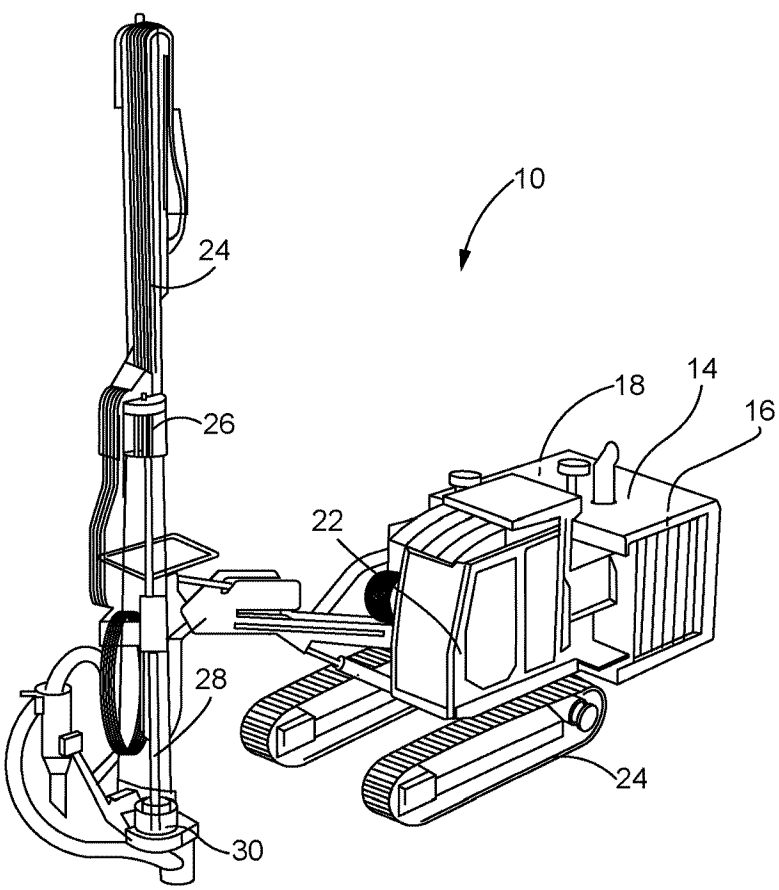
FIG. 2 is another side perspective view of the machine of FIG. 1.
Figure 1:
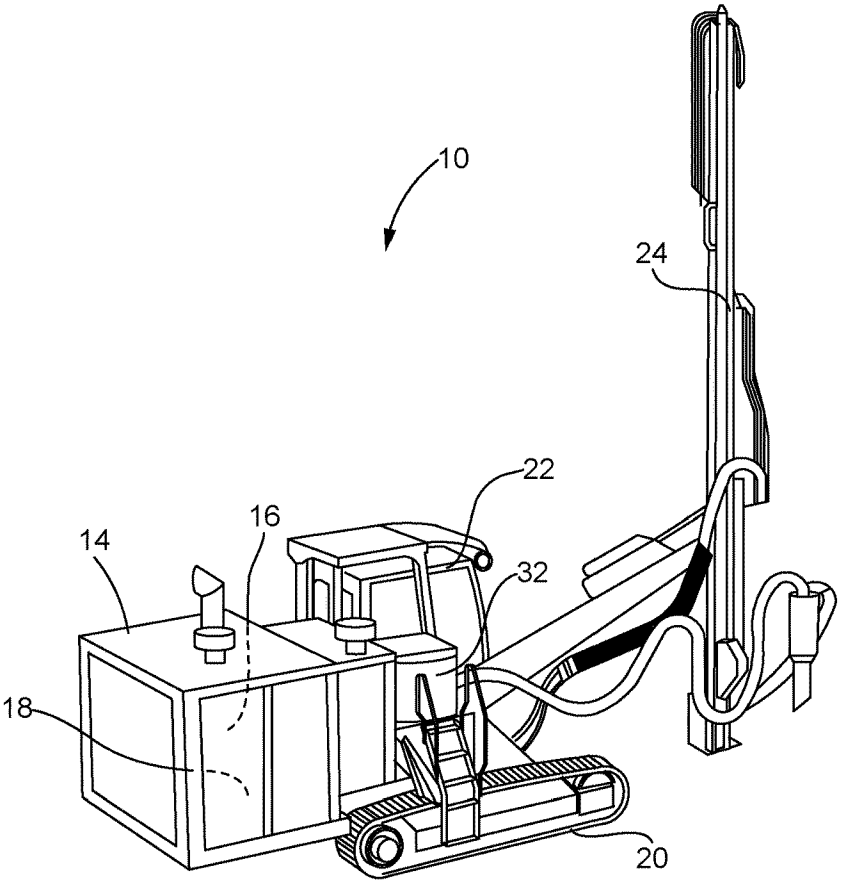
FIG. 1 is a side perspective view of a machine having a compressed air system.

Referring now to the drawings, and with specific reference to FIGS. 1-2, a machine 10 relying on compressed air to perform one or more operations is shown. As non-limiting examples, the machine 10 may be a drill machine such as a rotary drill machine or a track drill machine, as shown. As will be understood by those with ordinary skill in the art, a track drill machine and a rotary drill machine may have similar or nearly identical features, with the rotary drill machine being larger than the track drill machine. As such, FIGS. 1-2 and the following description of the machine 10 apply to both the track drill machine and the rotary drill machine, but will be referred to as the machine 10 throughout the description for simplicity. Alternatively, the machine 10 may be any other type of mobile or stationary machine or equipment that uses compressed air to perform one or more operations. The machine 10 may include a compressed air system 12 (see FIGS. 3-4) that generates the compressed air and delivers the compressed air to various downstream sites of the machine 10 as discussed in further detail below.

Figure 4:
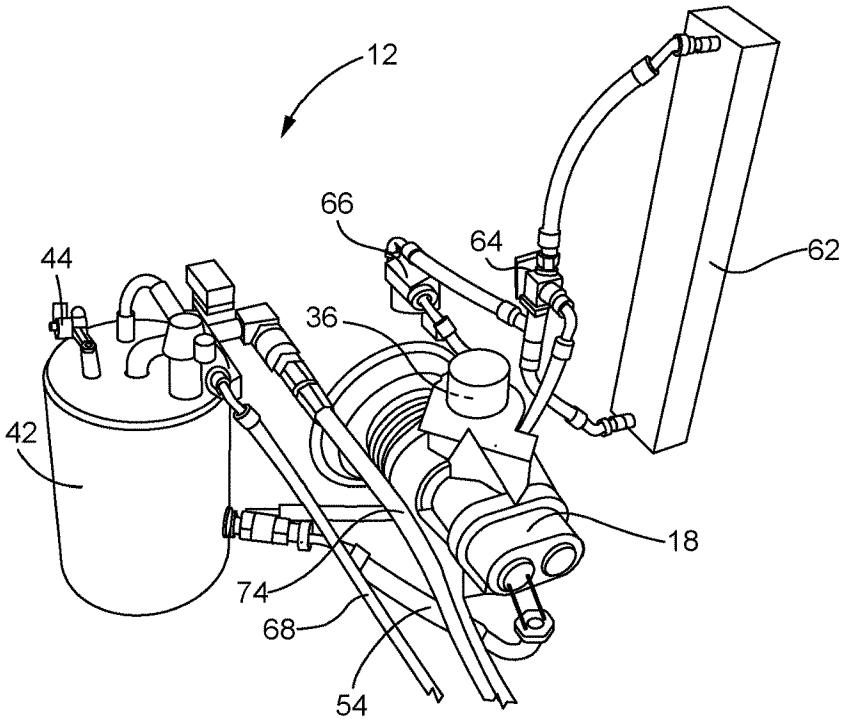
FIG. 4 is a perspective view of the compressed air system of FIG. 3 with some components removed for clarity.
Figure 3:
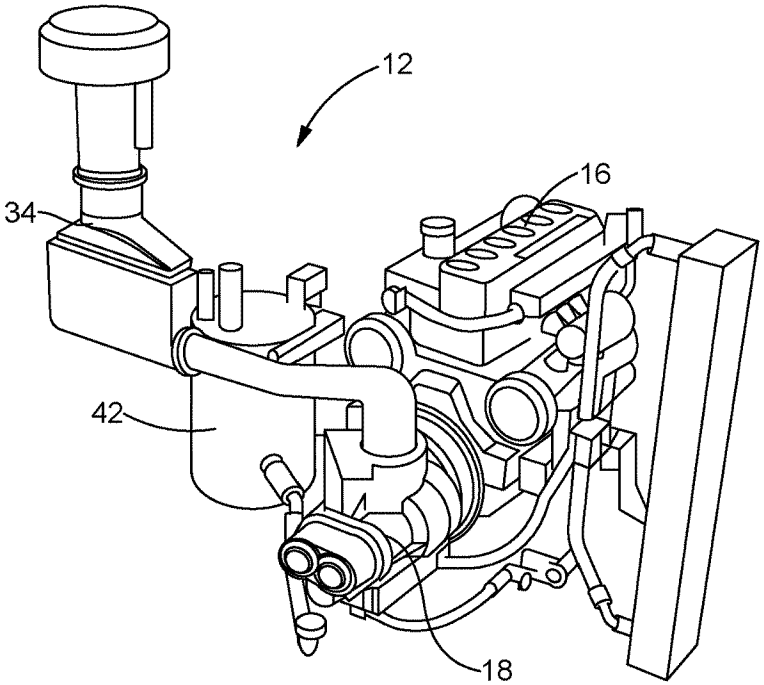
FIG. 3 is a perspective view of some of the components of the compressed air system.

Referring still to FIGS. 1-2, the machine 10 may include an enclosure 14 containing an internal combustion engine 16, and an air compressor 18 that is driven by the engine 16 and that produces the compressed air (also see FIGS. 3-4). The air compressor 18 may be a rotary screw compressor, although other types of suitable air compressors may also be used. In addition, the machine 10 may include tracks 20 (or wheels) to facilitate movement of the machine 10, and an operator cab 22. In some implementations, the machine 10 may be an unmanned machine with other arrangements. Furthermore, the machine 10 may have a mast 24 supporting a carousel 26 that carries one or more drill rods 28. Each of the drill rods 28 may have a drill bit 30 configured to drill a hole into a material or structure such as rock, earth, or other natural or man-made materials or structures. During drilling, compressed air from the air compressor 18 may be flowed through the drill rod 28 to flush dust or chips of the material out of the hole that is being drilled. The machine 10 may also include a dust collector 32 that pulls a vacuum to collect the dust that is blown out of the hole on one or more filters as the hole is being drilled. Periodically, compressed air from the air compressor 18 may be supplied to the dust collector 32 to clean the filters during a cleaning cycle of the machine 10, as will be described in further detail.

Figure 5:
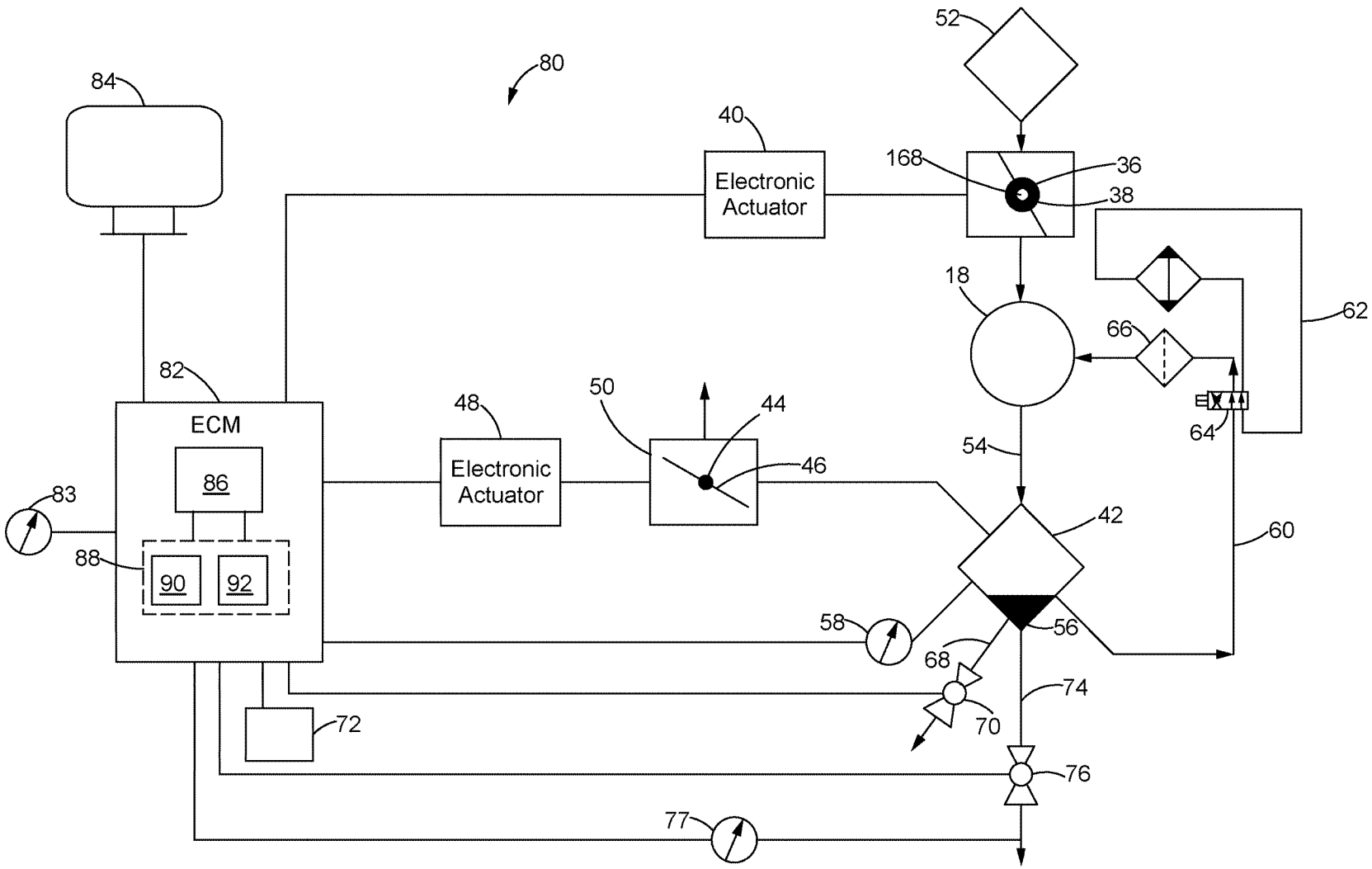
FIG. 5 is a schematic representation of an electronic control system for the compressed air system.

As shown in FIG. 3, the compressed air system 12 may include the air compressor 18 having an inlet 34 through which air from the external environment may enter the air compressor 18. As shown in FIG. 4, positioned along the inlet 34 may be an inlet valve 36 that varies its open or closed position to regulate the flow of the air into the air compressor 18. As shown in FIG. 5, in some embodiments, the inlet valve 36 may be a butterfly valve 38. Alternatively, the valve 36 may be another type of valve or flow regulating device apparent to those with ordinary skill in the art such as, but not limited to, a ball valve, a diaphragm valve, a needle valve, a check valve, and a plug valve. The open or closed position of the inlet valve 36 may be electronically controlled with an inlet electronic actuator 40 (see FIG. 5), although the inlet valve 36 may be pneumatically controlled in other arrangements.

Referring to FIG. 4, the compressed air system 12 may also include a reservoir 42 to store the compressed air generated by the air compressor 18. One or more outlet valves 44, or pressure release valves, may regulate a flow of the compressed air out of the reservoir 42 and prevent over pressurization of the reservoir 42. Specifically, the outlet valve 44 may permit excess compressed air to flow out of the reservoir 42 to the atmosphere (also see FIG. 5). In some embodiments, the outlet valve 44 may be a butterfly valve 46, as shown in FIG. 5. However, the outlet valve 44 may be other types of valves or flow regulating devices such as, but not limited to, a ball valve, a diaphragm valve, a needle valve, a check valve, and a plug valve. While the machine 10 is on or running, the outlet valve 44 may vary its open or closed position to regulate the flow of the compressed air out of the reservoir 42. As shown in FIG. 5, the open or closed position of the outlet valve 44 may be adjusted with an outlet electronic actuator 48 (see further details below).

When the machine 10 is off, the outlet valve 44 may be closed, but compressed air may passively leak out of the reservoir 42 to the atmosphere through clearances or spaces between the closed outlet valve 44 and an outlet bore 50 surrounding the outlet valve 44 (see FIG. 5). In some embodiments, the compressed air system 12 may include one or more separate outlet valves or pressure release valves that permit the compressed air to leak out of the reservoir 42 when the machine 10 is turned off.

The pressure of the compressed air in the reservoir 42 may be regulated to a target reservoir pressure that may vary according to the compressed air needs of the machine 10. As used herein, a "target reservoir pressure" may refer to a targeted pressure of compressed air in the reservoir 42 sufficient to support the active operations of the machine 10 that use compressed air. As explained in further detail below, the inlet valve 36 and the outlet valve 44 may be opened and closed as needed to charge the reservoir 42 at or near the target reservoir pressure, with the inlet valve 36 being opened to permit more compressed air to flow into the reservoir 42 when the pressure of the compressed air in the reservoir 42 is below the target reservoir pressure, and the outlet valve 44 being opened to permit release of compressed air from the reservoir 42 when the pressure of the compressed air in the reservoir 42 is above the target reservoir pressure.

Referring to FIG. 5, a schematic representation of the compressed air system 12 is shown. In operation, an air intake device 52 may draw in air from the external environment and direct the air to the inlet valve 36. The inlet valve 36 may permit the flow of the air to the air compressor 18 which may compress the air according to mechanisms well understood by those with ordinary skill in the art. The compressed air generated by the air compressor 18 may then be directed to the reservoir 42 through one or more reservoir charging lines 54 (also see FIG. 4). The reservoir 42 may also store oil or lubricating fluid 56 that is used to lubricate the air compressor 18. A reservoir pressure sensor 58 may be associated with the reservoir 42 to monitor the pressure of the compressed air in the reservoir, or the "actual reservoir pressure." Also associated with the reservoir 42 may be the outlet valve 44 to release compressed air to the atmosphere.

The compressed air stored in the reservoir 42 may be delivered to one or more downstream sites to support one or more operations of the machine 10. For example, the compressed air stored in the reservoir 42 may be used to perform or support one or more standby operations at a fixed standby pressure. As used herein, a "standby operation" may be an operation that is performed constantly during the operation of the machine 10. In addition, as used herein, a "fixed standby pressure" may be a predetermined and fixed pressure of the compressed air that is used to carry out the standby operation. For example, the standby operation may be the delivery of the oil 56 to the to the air compressor 18 through one or more standby service lines 60 for lubrication of the air compressor 18. In this example, the oil 56 flowing through the service line 60 may enter an oil cooler 62 through a thermal valve 64 if the temperature of the oil is too high before passing through an oil filter 66 and being directed to the air compressor 18 (also see FIG. 4). Alternatively, if the temperature of the oil 56 is not too high, the oil 56 may be directly passed through the oil filter 66 and to the air compressor 18 without passing through the oil cooler 62.

The compressed air stored in the reservoir 42 may also be used to perform or support one or more fixed-pressure auxiliary operations at a fixed auxiliary pressure. As used herein, a "fixed-pressure auxiliary operation" may be an operation that is performed intermittently during the operation of the machine, and a "fixed auxiliary pressure" may be a predetermined and fixed pressure of the compressed air that is used to carry out the fixed-pressure auxiliary operation. Accordingly, the "fixed-pressure auxiliary operation" may be active or inactive at any given time during the operation of the machine 10. The compressed air that is used for the fixed-pressure auxiliary operation may be delivered to a target downstream site through one or more auxiliary service lines 68 (also see FIG. 4). As a non-limiting example, the fixed-pressure auxiliary operation may be the delivery of the compressed air to the dust collector 32 to clean the filter(s) of the dust collector 32 during the cleaning cycle of the machine 10. The fixed-pressure auxiliary operation may be activated or inactivated with a valve 70 (or other flow-regulating device).

Furthermore, the compressed air stored in the reservoir 42 may be used to perform or support one or more variable-pressure auxiliary operations at a variable auxiliary pressure. As used herein, a "variable-pressure auxiliary operation" is an operation that is performed periodically or intermittently during the operation of the machine 10, and a "variable auxiliary pressure" is a variable pressure of the compressed air that is used to perform the variable-pressure auxiliary operation. Thus, the variable-pressure auxiliary operation may be active or inactive at any given time during the operation of the machine 10. The compressed air that is used to perform the variable-pressure auxiliary operation may be delivered to a target downstream site through one or more auxiliary service lines 74 (also see FIG. 4). For example, the variable-pressure auxiliary operation may be the delivery of the compressed air down the drill rod 28 when drilling is active to flush dust out of the hole that is being drilled. As shown in FIG. 5, the auxiliary service line 74 may include a valve 76, such as a ball valve or another type of valve or flow-regulating device, that is opened and closed to inactivate or inactivate the variable-pressure auxiliary operation. As shown in FIG. 5, a pressure sensor 77 may be installed on an outlet side of the valve 76 to monitor the pressure (e.g., the variable auxiliary pressure) used for the variable-pressure auxiliary operation (also see FIG. 7 below).

In some implementations, the compressed air stored in the reservoir 42 may be used to support multiple fixed-pressure auxiliary operations, multiple variable-pressure auxiliary operations, and/or multiple standby operations. As yet another possibility, the compressed air stored in the reservoir may be used to support only one or two fixed-pressure auxiliary operations, variable-pressure auxiliary operations, or standby operations. Variations such as these also fall within the scope of the present disclosure.

Referring still to FIG. 5, an electronic control system 80 may regulate the open or closed position of the inlet valve 36 and the outlet valve 44 so that the reservoir 42 is charged at the target reservoir pressure that is needed carry out the standby operation(s) and the active auxiliary operation(s) of the machine 10. Specifically, the electronic control system 80 may adjust the open or closed position of the inlet valve 36 and the outlet valve 44 when the actual reservoir pressure deviates from the target reservoir pressure. The electronic control system 80 may include the inlet electronic actuator 40, the outlet electronic actuator 48, as well as an electronic control module (ECM) 82 that is in electronic or wireless communication with the inlet and outlet electronic actuators 40 and 48 for control thereof. Specifically, the ECM 82 may transmit commands to the inlet electronic actuator 40 and the outlet electronic actuator 48 to open or close the inlet valve 36 and the outlet valve 44 to minimize a pressure difference between the target reservoir pressure and the actual reservoir pressure.

To determine the target reservoir pressure and to monitor the actual reservoir pressure, the ECM 82 may also be in electronic or wireless communication with the pressure sensors 58 and 77, an engine speed sensor 83 that informs the ECM 82 as to the on or off status of the machine 10, and an operator input control 72 such as a joystick, keypad, or operator control panel (see further details below). The operator input control 72 may notify the ECM 82 to activate or inactivate the fixed-pressure auxiliary operation and the variable-pressure auxiliary operation. In this regard, the ECM 82 may also be in electronic or wireless communication with the valves 70 and 76 to activate or inactivate the fixed-pressure auxiliary operation and the variable-pressure auxiliary operation according to commands from the operator input control 72. For example, the ECM 82 may control the valves 70 and 76 directly, or it may control the valves 70 and 76 through an auxiliary control. Optionally, the ECM 82 may also be in electronic or wireless communication with a pressure input control 84 that permits an operator or technician to input set pressure values for the standby operation and/or the auxiliary operation(s) (see further details below). The pressure input control 84 may be any appropriate input device such as a computer terminal, a hand-held device, an external storage device, or an electronic adjustment device (e.g., an analog rotary dial, a rheostat, etc.) connected to the ECM 82.

As shown in FIG. 5, the ECM 82 may include a microprocessor 86 for executing one or more instructions (e.g., one or more programs) involved in regulating the inlet valve 36 and the outlet valve 44. The microprocessor 86 may include a memory 88, such as a read only memory (ROM) 90 that may store one or more instructions (e.g., one or more programs), as well as a random access memory (RAM) 92 that may serve as a working memory for use in executing the programs stored in the memory 88.

Figure 6:
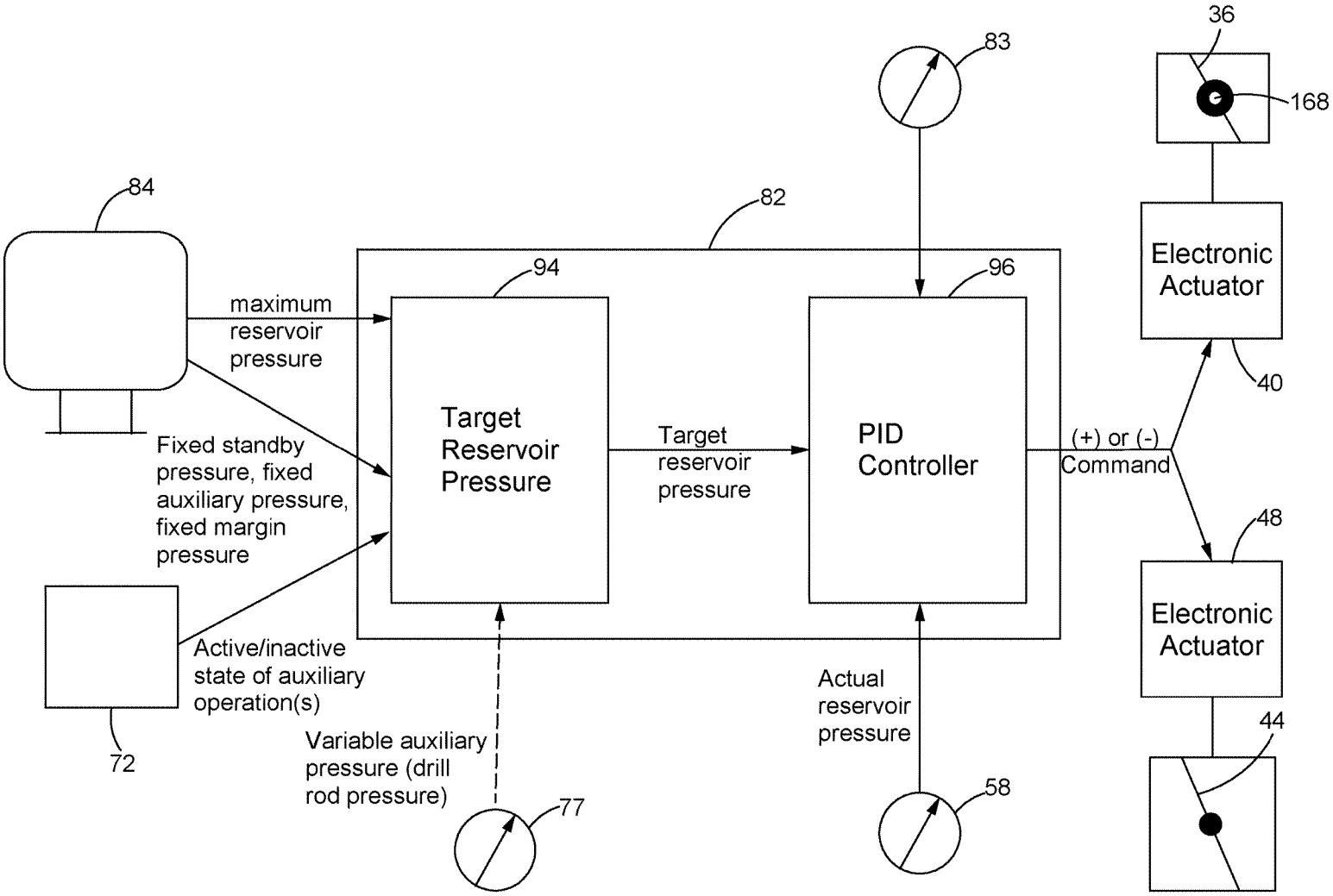
FIG. 6 is a schematic block diagram of a strategy for regulating the pressure of compressed air in a reservoir of the compressed air system as implemented by an electronic control module (ECM) of the electronic control system.

FIG. 6 illustrates a strategy for regulating the open or closed positions of the inlet valve 36 and the outlet valve 44 as implemented by the ECM 82. The ECM 82 may include a target reservoir pressure module 94 that determines the target reservoir pressure, and a proportional-integral-derivative (PID) controller 96 that transmits a command to the electronic actuators 40 and 48 based on the difference between the target reservoir pressure and the actual reservoir pressure. As shown in FIG. 6, to determine the target reservoir pressure, the target reservoir pressure module 94 may receive input from the operator input control 72 indicating the active or inactive states of the fixed-pressure auxiliary operation(s) and the variable-pressure auxiliary operation(s). In addition, when the variable-pressure auxiliary operation is active, the target reservoir pressure module 94 may receive signals from the pressure sensor 77 in the auxiliary service line 74 indicating the variable auxiliary pressure. From the pressure input control 84, the target reservoir pressure module 94 may receive set pressure values for the fixed standby pressure, the fixed auxiliary pressure, and a fixed margin pressure that is applied to the variable auxiliary pressure when the variable-pressure auxiliary operation is active. In addition, from the pressure input control 84, the target reservoir pressure module 94 may receive a set value for the maximum reservoir pressure which is reflective of the maximum pressure capacity of the reservoir 42. Alternatively, one or more of the set pressure values (i.e., the set pressure values for the fixed standby pressure, the fixed auxiliary pressure, the fixed margin pressure, and/or the maximum reservoir pressure) may be stored in the memory 88 of the ECM 82. Based on the set pressure values, the variable auxiliary pressure, and the active or inactive states of the fixed-pressure auxiliary operation and the variable-pressure auxiliary operation, the target reservoir pressure module 94 may determine a value for the target reservoir pressure and output the target reservoir pressure to the PID controller 96 (see further details below).

The PID controller 96 may receive signals indicative of the actual reservoir pressure from the pressure sensor 58, and may determine if a pressure difference exists between the actual reservoir pressure and the target reservoir pressure. If a pressure difference is detected, the PID controller 96 may transmit a command (e.g., a positive (+) or negative (−) command) to the inlet electronic actuator 40 and the outlet electronic actuator 48 to cause the inlet valve 36 and the outlet valve 44 to open or close. Specifically, if the actual reservoir pressure is below the target reservoir pressure, the PID controller 96 may transmit a positive (+) command to the electronic actuators 40 and 48, causing the inlet valve 36 to at least partially open and the outlet valve 44 to close. If the actual reservoir pressure is above the target reservoir pressure, the PID controller 96 may transmit a negative (−) command to the electronic actuators 40 and 48, causing the inlet valve 36 to close and the outlet valve 44 to at least partially open. The command (e.g., the positive or negative command) transmitted by the PID controller 96 may be proportional to the pressure difference between the actual reservoir pressure and the target reservoir pressure, such that the electronic actuators 40 and 48 open the inlet valve 36 or the outlet valve 44 by a degree that is proportional to the pressure difference. It is noted here that in some implementations, the ECM 82 may only transmit commands to the outlet electronic actuator 44 to regulate the position of the outlet valve 44, and the inlet valve 36 may be separately controlled.

Figure 7:
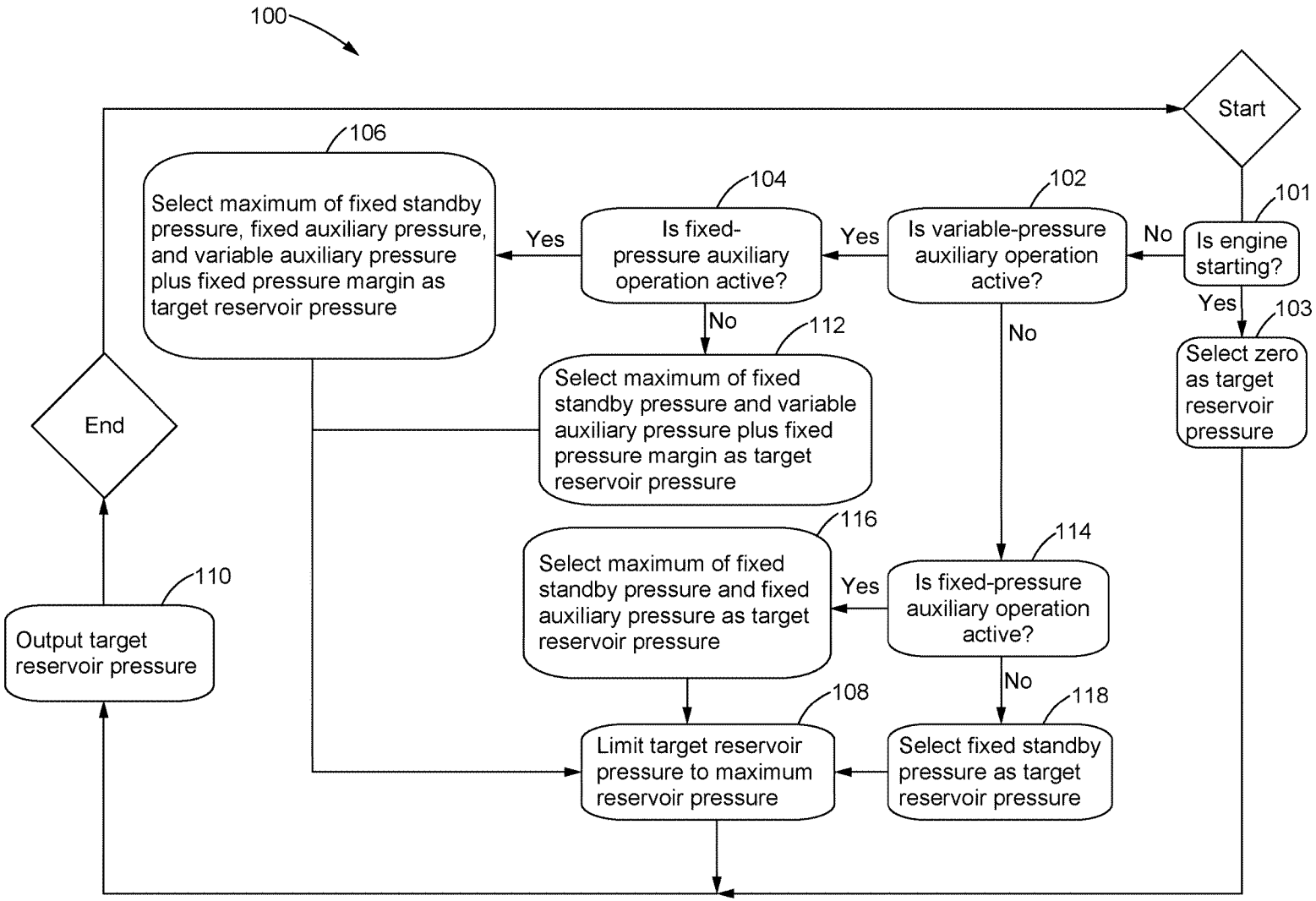
FIG. 7 is a flowchart of an exemplary method for determining a target reservoir pressure for the compressed air in the reservoir as implemented by the ECM.

Turning now to FIG. 7, an exemplary method 100 for determining the target reservoir pressure as implemented by the ECM 82 is shown. The exemplary method 100 may be performed by the target reservoir pressure module 94, or it may be performed by another element or component of the ECM 82 alone or in conjunction with the target reservoir pressure module 94. According to a block 101, the target reservoir pressure module 94 may determine if the engine 16 is in the process of starting or turning on. If the engine 16 is starting, the target reservoir pressure module 94 may select zero as the target reservoir pressure according to a block 103, and may output the target reservoir pressure to the PID controller 96 according to a block 110. Setting the target reservoir pressure to zero when the engine 16 is starting may advantageously reduce the load of the compressor 18 on the engine 16. This feature may be advantageous, for example, when starting the engine under cold conditions.

If the engine 16 is not starting (i.e., the engine 16 has been running for some time), the target reservoir pressure module 94 may determine whether the variable-pressure auxiliary operation is active based on input from the pressure sensor 77 and/or the operator input control 72 (block 102). For instance, if the variable-pressure auxiliary operation is the delivery of compressed air to the drill rod 28, the target reservoir pressure module 94 may receive signals from the pressure sensor 77 indicating that drilling is active when the pressure sensor 77 detects pressure in the auxiliary service line 74. If the variable-pressure auxiliary operation is active, the target reservoir pressure module 94 may determine if the fixed-pressure auxiliary operation is active (block 104). If, for example, the fixed-pressure auxiliary operation is the delivery of the compressed air to the dust collector 32 for filter cleaning, the target reservoir pressure module 94 may receive signals from the operator input control 72 indicating whether the cleaning cycle is active.

If both the variable-pressure auxiliary operation and the fixed-pressure auxiliary operation are active (e.g., drilling and dust collector filter cleaning are both active), the target reservoir pressure module 94 may select the maximum pressure out of the fixed standby pressure, the fixed auxiliary pressure, and the variable auxiliary pressure plus the fixed margin pressure as the target reservoir pressure (block 106). As explained above, the fixed standby pressure, the fixed auxiliary pressure, and the fixed margin pressure that is applied to the variable auxiliary pressure may be set values that are stored in the memory 88 of the ECM 82, or set values that are input into the ECM 82 using the pressure input control 84. In addition, the target reservoir pressure module 94 may receive signals from the pressure sensor 77 indicating the variable auxiliary pressure in the auxiliary service line 74 (also see FIG. 6). As an illustrative example, if the set value for the fixed standby pressure is 50 pounds per square inch (psi), the set value for the fixed auxiliary pressure is 70 psi, the variable auxiliary pressure detected by the pressure sensor 77 is 25 psi, and the set value for the fixed margin pressure is 20 psi, the target reservoir pressure module 94 may select 70 psi as the target reservoir pressure as it is the maximum pressure of 50 psi, 70 psi, and 45 psi (the sum of 25 psi plus 20 psi).

The target reservoir pressure module 94 may then limit the target reservoir pressure to the maximum reservoir pressure to prevent over pressurizing the reservoir 42 (block 108). For instance, if the target reservoir pressure is above the maximum reservoir pressure, the target reservoir pressure module 94 may reduce the target reservoir pressure to the maximum reservoir pressure. If, however, the target reservoir pressure is below the maximum reservoir pressure, the target reservoir pressure will not be adjusted. The target reservoir pressure module 94 may then output the target reservoir pressure to the PID controller 96 (block 110).

Alternatively, if the variable-pressure auxiliary operation is active and the fixed-pressure auxiliary operation is inactive (e.g., the dust collector cleaning cycle is inactive, and drilling is active), the target reservoir pressure module 94 may select the maximum pressure out of the fixed standby pressure and the variable auxiliary pressure plus the fixed pressure margin as the target reservoir pressure (block 112), and may limit the target reservoir pressure to the maximum reservoir pressure if the target reservoir pressure is above the maximum reservoir pressure (block 108). The target reservoir pressure module 94 may then output the target reservoir pressure to the PID controller 96 (block 110).

If the variable-pressure auxiliary operation is inactive, the target reservoir pressure module 94 may determine whether the fixed-pressure auxiliary operation is active (block 114). If the fixed-pressure auxiliary operation is active, the target reservoir pressure module 94 may select the maximum pressure out of the fixed standby pressure and the fixed auxiliary pressure as the target reservoir pressure (block 116), and may limit the target reservoir pressure to the maximum reservoir pressure if the target reservoir pressure is above the maximum reservoir pressure (block 108). The target reservoir pressure may then be output to the PID controller 96 (block 110).

If both the variable-pressure auxiliary operation and the fixed-pressure auxiliary operation are inactive, the target reservoir pressure module 94 may select the fixed standby pressure as the target reservoir pressure (block 118), and may limit the target reservoir pressure to the maximum reservoir pressure if the target reservoir pressure is above the maximum reservoir pressure (block 108). The target reservoir pressure may then be output to the PID controller 96 (block 110). The method of FIG. 7 may be repeated throughout the operation of the machine 10 so as to adjust the target reservoir pressure as the active/inactive states of the auxiliary operations vary. It is noted that the method of FIG. 7 is exemplary, and that the blocks 102, 104, 106, 108, 110, 112, 114, 116, and 118 may be carried out in different orders and/or simultaneously.

Figure 8:
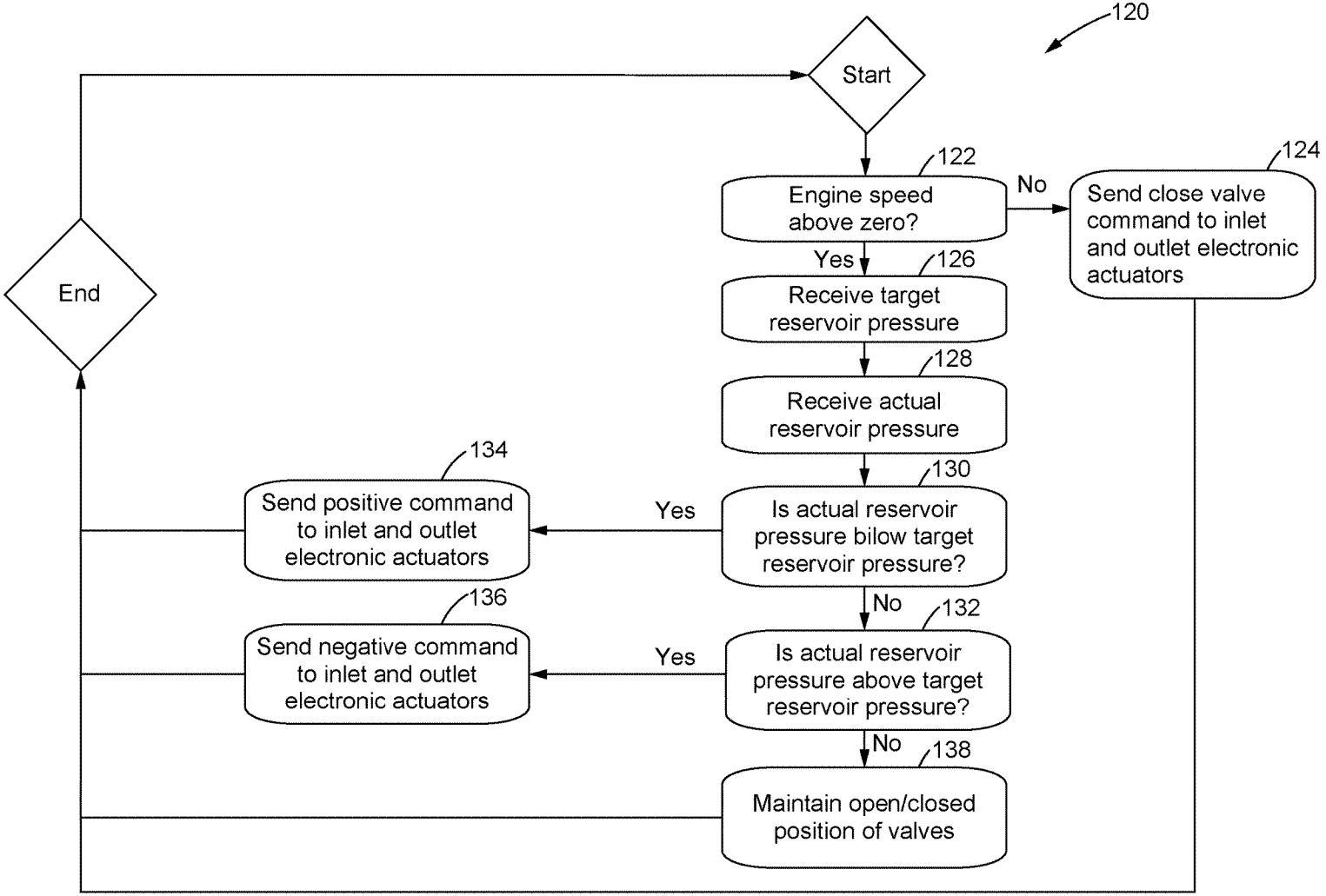
FIG. 8 is a flowchart of an exemplary method for controlling an open or closed position of an inlet valve and an outlet valve of the compressed air system as implemented by the ECM.

Referring now to FIG. 8, an exemplary method 120 for controlling an open or closed position of the inlet valve 36 and the outlet valve 44 as implemented by the PID controller 96 (or by another element or module of the ECM 82 alone or in conjunction with the PID controller 96) is shown. At a block 122 of the method 120, the PID controller 96 may determine if the engine speed is above zero based on the engine speed signal received from the engine speed sensor 83 (also see FIG. 6). If the engine speed is zero (indicating that the machine 10 is off), the PID controller 96 may transmit a close valve command to the inlet electronic actuator 40 and the outlet electronic actuator 48 according to a block 124, causing the inlet valve 36 and the outlet valve 44 to close. With the outlet valve 44 closed, compressed air may bleed out of the reservoir 42 to the atmosphere through clearances between the outlet valve 44 and the outlet bore 50 (also see FIG. 5). In alternative arrangements, the compressed air may be bled out of the reservoir 42 through a separate valve when the machine is turned off.

If the engine speed is above zero (indicating that the machine 10 is on or running), the PID controller 96 may regulate the open or closed position of the inlet and outlet valves 36 and 44 based on the pressure difference between the actual reservoir pressure and the target reservoir pressure. In this regard, the PID controller 96 may receive the target reservoir pressure from the target reservoir pressure module 94 (block 126) and the actual reservoir pressure from the reservoir pressure sensor 58 (block 128), with the blocks 126 and 128 being carried out in any order or simultaneously. The PID controller 96 may compare the actual reservoir pressure to the target reservoir pressure according to blocks 130 and 132. Specifically, the PID controller 96 may determine if the actual reservoir pressure is below (block 130) or above (block 132) the target reservoir pressure. If the actual reservoir pressure is below the target reservoir pressure, the pressure of the compressed air in the reservoir 42 may not be sufficient to support the standby operation(s) and/or the active auxiliary operation(s) of the machine 10. As such, the PID controller 96 may transmit a positive command to the inlet electronic actuator 40 and the outlet electronic actuator 48 (block 134). The inlet electronic actuator 40 may interpret the positive command as a command to open the inlet valve 36, while the outlet electronic actuator 48 may interpret the positive command as a command to close the outlet valve 44. As a result, the inlet valve 36 may open and the outlet valve 44 may close, allowing the actual reservoir pressure in the reservoir 42 to rise to or approach the target reservoir pressure as more compressed air flows from the air compressor 18 to the reservoir 42.

If the actual reservoir pressure is above the target reservoir pressure, the pressure of the compressed air in the reservoir 42 may be higher than is needed to carry out the standby operation(s) and the active auxiliary operation(s) of the machine 10. Accordingly, the PID controller 96 may transmit a negative command to the inlet electronic actuator 40 and the outlet electronic actuator 48 (block 136). The inlet electronic actuator 40 may interpret the negative command as a command to close the inlet valve 36, while the outlet electronic actuator 48 may interpret the negative command as a command to open the outlet valve 44. Consequently, the inlet valve 36 may close and the outlet valve 44 may open, allowing the actual reservoir pressure to fall as compressed air is released from the reservoir 42 through the outlet valve 44. If the actual reservoir pressure is equivalent to the target reservoir pressure, the open or closed positions of the valves 36 and 44 may be maintained (block 138). It will be understood that the method 120 of FIG. 8 is exemplary, and that the blocks 122, 124, 126, 128, 130, 132, 134, 136, and 138 may be carried out in any order or simultaneously. In other arrangements, the PID controller 96 may only transmit commands to the outlet electronic actuator 48, and the inlet valve 36 may be controlled separately. For example, the inlet valve 36 may be pneumatically controlled.

The PID controller 96 may repeat the method 120 continuously throughout the operation of the machine 10 to regulate the actual reservoir pressure in the reservoir 42 to the target reservoir pressure. In other arrangements, the PID controller 96 may only regulate the actual reservoir pressure through commands to the outlet electronic actuator 48, and the inlet valve 36 may be controlled separately such as through a pneumatic actuator or another type of actuator. Those with ordinary skill in the art will appreciate that the methods of FIGS. 7-8 may be modified to accommodate more or fewer standby operations, and/or more or fewer fixed-pressure or variable-pressure auxiliary operations. Variations such as these also fall within the scope of the present disclosure.

INDUSTRIAL APPLICABILITY

In general, the teachings of the present disclosure may find applicability in many industries including, but not limited to, construction, mining, agriculture, and automotive industries. More specifically, the present disclosure may find applicability in any industry using machines or equipment that rely on compressed air to perform operations that are not constantly active.

Figure 9:
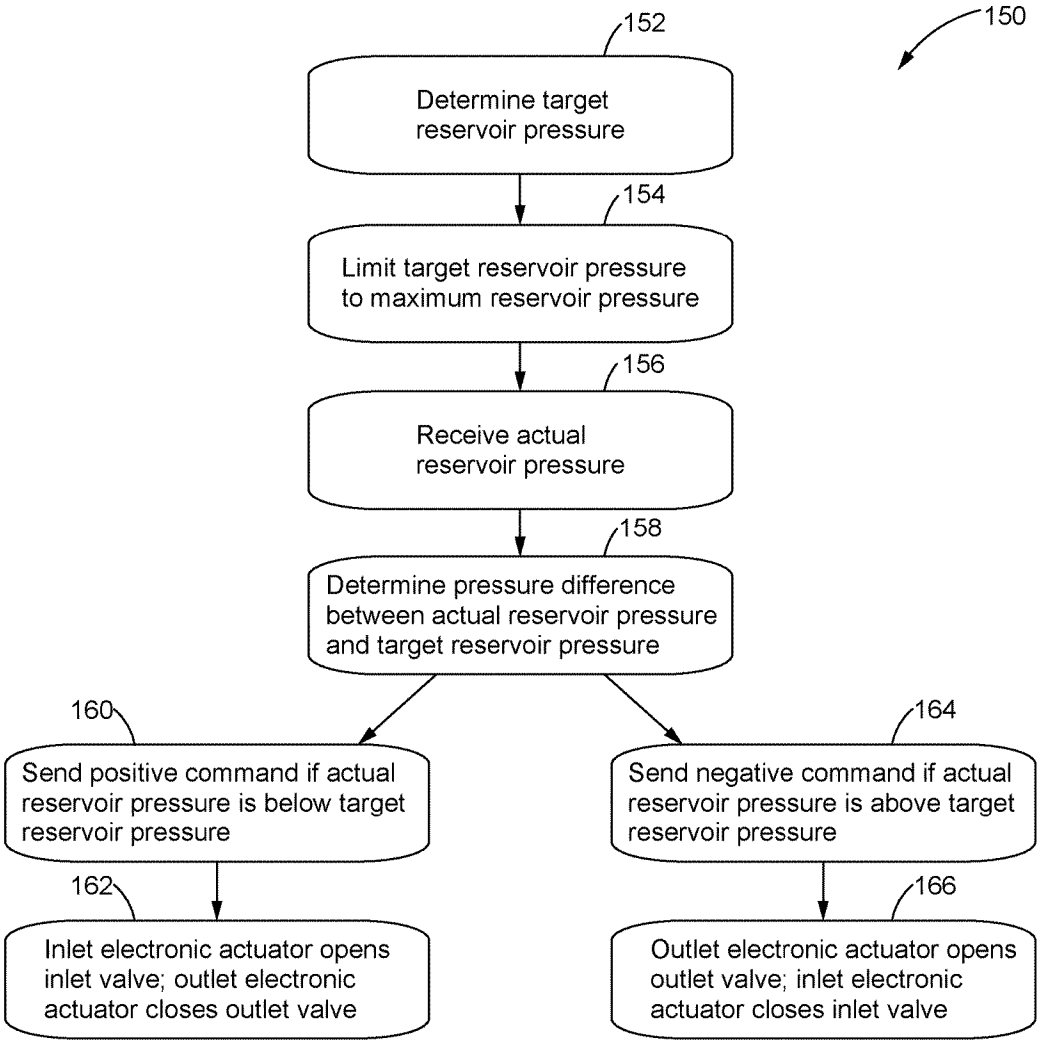
FIG. 9 is a flowchart of an exemplary method of regulating the pressure of compressed air in the reservoir as implemented by the electronic control system.

Referring to FIG. 9, an exemplary method 150 for regulating the pressure of compressed air in the reservoir 42 using the electronic control system 80 is shown. At a block 152, the ECM 82 of the electronic control system 80 may determine the target reservoir pressure of the reservoir 42. If the engine 16 is in the process of starting or turning on, the block 152 may involve selecting zero as the target reservoir pressure to reduce the load of the compressor 18 on the engine 16 during engine start. If the engine 16 is not starting, the block 152 may involve determining the active or inactive states of the fixed-pressure auxiliary operation(s) and the variable-pressure auxiliary operation(s) of the machine 10 (see FIG. 7 and corresponding description). In addition, the block 152 may further involve selecting the target reservoir pressure as a maximum of a set value for the fixed standby pressure, a set value for the fixed auxiliary pressure if the fixed-pressure auxiliary operation is active, and the variable auxiliary pressure (as monitored by the pressure sensor 77) plus the fixed margin pressure if the variable-pressure auxiliary operation is active (see FIG. 7 and corresponding description). By applying the fixed margin pressure to the variable auxiliary pressure, the electronic control system 80 may charge the reservoir 42 to a pressure that is slightly above the pressure demand of the variable-pressure auxiliary operation. In addition, the ECM 82 may limit the target reservoir pressure to the maximum reservoir pressure if the target reservoir pressure is above the maximum reservoir pressure (block 154).

The ECM 82 may receive the actual reservoir pressure from the pressure sensor 58 (block 156) (also see FIG. 6), and may determine the pressure difference (if any) between the actual reservoir pressure and the target reservoir pressure (block 158). If the actual reservoir pressure is below the target reservoir pressure, the ECM 82 may transmit a positive command to the inlet electronic actuator 40 and the outlet electronic actuator 48 (block 160), thereby causing the inlet electronic actuator 40 to open the inlet valve 36 by a degree proportional to the pressure difference, and causing the outlet electronic actuator 48 to close the outlet valve 44 (block 162). As a result, the actual reservoir pressure may increase towards the target reservoir pressure as more compressed air flows into the reservoir 42 from the air compressor 18. However, if the actual reservoir pressure is above the target reservoir pressure, the ECM 82 may transmit a negative command to the inlet electronic actuator 40 and the outlet electronic actuator 48 (block 164), causing the outlet electronic actuator 48 to open the outlet valve 44 by a degree, and the inlet electronic actuator 40 to close the inlet valve 36 (block 166). Consequently, the actual reservoir pressure may drop towards the target reservoir pressure as compressed air flows out of the reservoir 42 through the open outlet valve 44. Accordingly, the ECM 82 may coordinate opening and closing of the inlet valve 36 and the outlet valve 44 to reach the target reservoir pressure, with the inlet valve 36 being opened when the outlet valve 44 is closed, and the outlet valve 44 being opened when the inlet valve 36 is closed. In some embodiments, the degree may be proportional to the pressure difference.

According to the above method 150, if the variable-pressure auxiliary operation (e.g., drilling) is active, the actual reservoir pressure may fall below the target reservoir as the reservoir 42 delivers large volumes of compressed air to the downstream target (e.g., the drill rod 28). As a result, the ECM 82 may transmit a positive command to open the inlet valve 36, and to close the outlet valve 44 to ensure that compressed air needed for the operation is not lost to the atmosphere through the outlet valve 44. Thus, electronic control of the outlet valve 44 as disclosed herein may increase efficiency and reduce power loads on the engine compared to prior art systems in which running blow down valves remain open during drilling.

In another scenario, the fixed-pressure auxiliary operation and the variable-pressure auxiliary operation may be inactive, such that the reservoir 42 only needs to be charged with enough compressed air to support the standby operation(s) of the machine 10. With lower compressed air demands, ECM 82 may transmit a command to close the inlet valve 36, although air may leak through the inlet valve 36 into the air compressor 18 through one or more openings 168 in the butterfly valve 38 (see FIGS. 5-6). Due to such air leakage through the inlet valve 36, the pressure of compressed air in the reservoir 42 may rise and eventually surpass the target reservoir pressure. To release compressed air when the actual reservoir pressure exceeds the target reservoir pressure, the ECM may command the outlet valve 44 to open and allow the excess air to bleed out to the atmosphere.

In yet another scenario, when the engine 16 is in the process of starting or turning on, the ECM 82 may set the target reservoir pressure to zero. In this case, the actual reservoir pressure may be above the target reservoir pressure, such that the ECM 82 may transmit a command to close the inlet valve 36 and open the outlet valve 44. With the inlet valve 36 closed, the load of the compressor 18 on the engine 16 during engine start-up may be advantageously reduced.

The electronic control system disclosed herein dynamically regulates the pressure of compressed air in the reservoir according to the fluctuating compressed air demands of the machine. More particularly, the electronic control system of the present disclosure regulates the open or closed positions of the inlet valve and the outlet valve so that compressed air is delivered to and released from the reservoir as needed to regulate the reservoir pressure to the target reservoir pressure. Moreover, the electronic control system may open the inlet valve or the outlet valve by a degree that is proportional to the pressure difference between the actual reservoir pressure and the target reservoir pressure, so that the reservoir pressure reaches the target reservoir pressure rapidly when large pressure differences exist. This is yet another advantage over running blow down valves of the prior art which may bleed compressed air out more slowly through a fixed orifice. Electronic control of the reservoir outlet valve may also offer improved reliability and flexibility over pneumatically controlled blow down valves of the prior art.

It is expected that the technology disclosed herein may find wide industrial applicability in a wide range of areas such as, but not limited to, construction, automotive, marine, mining, agriculture, and earth-moving equipment applications.

What is claimed is:

1. A compressed air system for a machine, the compressed air system comprising:

an air compressor configured to generate compressed air;

a reservoir configured to store the compressed air generated by the air compressor;

a reservoir pressure sensor configured to monitor an actual reservoir pressure of the compressed air stored in the reservoir;

an outlet valve configured to variably regulate a flow of the compressed air out of the reservoir, wherein the outlet valve is a butterfly valve;

an outlet electronic actuator operatively associated with the outlet valve to adjust a position of the outlet valve; and an electronic control module (ECM) in electronic communication with the reservoir pressure sensor and the outlet electronic actuator, the ECM being configured to:

transmit a command to the outlet electronic actuator to cause the outlet electronic actuator to at least partially open the outlet valve when the actual reservoir pressure is above a target reservoir pressure, transmit a command to the outlet electronic actuator to cause the electronic actuator to close the outlet valve when the actual reservoir pressure is below the target reservoir pressure; and wherein the butterfly valve is configured to permit leakage of compressed air when the butterfly valve is closed.

2. The compressed air system of claim 1, wherein the ECM is further configured to transmit a command to the outlet electronic actuator to cause the outlet electronic actuator to close the outlet valve when the machine is turned off.

3. The compressed air system of claim 1, wherein the ECM is further configured to select zero as the target reservoir pressure when an engine of the machine is starting.

4. The compressed air system of claim 1, wherein the compressed air system further comprises:

an inlet valve configured to regulate a flow of air to an inlet of the air compressor; and an inlet electronic actuator operatively associated with the inlet valve and configured to adjust a position of the inlet valve.

5. The compressed air system of claim 4, wherein the ECM is in electronic communication with the inlet electronic actuator and is further configured to:

transmit a command to the inlet electronic actuator to cause the inlet electronic actuator to close the inlet valve when the actual reservoir pressure is above the target reservoir pressure; and transmit a command to the inlet electronic actuator to cause the inlet electronic actuator to at least partially open the inlet valve when the actual reservoir pressure is below the target reservoir pressure.

6. The compressed air system of claim 4, wherein the inlet valve is a butterfly valve.

7. The compressed air system of claim 4, wherein the ECM includes a proportional-integral-derivative (PID) controller configured to:

transmit a positive command to the inlet electronic actuator and the outlet electronic actuator when the actual reservoir pressure is below the target reservoir pressure, the inlet electronic actuator interpreting the positive command as a command to at least partially open the inlet valve, the outlet electronic actuator interpreting the positive command as a command to close the outlet valve; and transmit a negative command to the inlet electronic actuator and the outlet electronic actuator when the actual reservoir pressure is above the target reservoir pressure, the inlet electronic actuator interpreting the negative command as a command to close the inlet valve, the outlet electronic actuator interpreting the negative command as a command to open the outlet valve.

8. The compressed air system of claim 1, wherein the compressed air, stored in the reservoir, is used to perform:

at least one standby operation that is performed constantly during the operation of the machine at a fixed standby pressure;

at least one fixed-pressure auxiliary operation that is performed intermittently during the operation of the machine at a fixed auxiliary pressure; and at least one variable-pressure auxiliary operation that is performed intermittently during the operation of the machine at a variable auxiliary pressure.

9. The compressed air system of claim 8, wherein the ECM is further configured to select the target reservoir pressure as a maximum out of the fixed standby pressure and the variable auxiliary pressure plus a fixed margin pressure when the at least one variable-pressure auxiliary operation is active and the fixed-pressure auxiliary operation is inactive.

10. The compressed air system of claim 8, wherein the ECM is further configured to select the target reservoir pressure as the fixed standby pressure when the at least one variable-pressure auxiliary operation and the fixed-pressure auxiliary operation are inactive.

11. A method for electronically controlling a pressure of compressed air stored in a reservoir of a compressed air system of a machine, the reservoir including an outlet valve configured to variably regulate a flow of the compressed air out of the reservoir, the method comprising:

determining a pressure difference between an actual reservoir pressure of the compressed air stored in the reservoir and a target reservoir pressure, the actual reservoir pressure being monitored by a reservoir pressure sensor;

transmitting a command to an outlet electronic actuator to cause the outlet electronic actuator to at least partially open the outlet valve when the actual reservoir pressure is above the target reservoir pressure, wherein the outlet valve is a butterfly valve;

transmitting a command to the outlet electronic actuator to cause the outlet electronic actuator to close the outlet valve when the actual reservoir pressure is below the target reservoir pressure; and wherein the butterfly valve is configured to permit leakage of the compressed air when the butterfly valve is closed.

12. The method of claim 11, further comprising transmitting a command to the outlet electronic actuator to cause the outlet electronic actuator to close the outlet valve when the machine is turned off, the outlet valve permitting compressed air to bleed out when closed.

13. The method of claim 11, further comprising determining the target reservoir pressure for the compressed air stored in the reservoir prior to determining the pressure difference between the actual reservoir pressure of the compressed air stored in the reservoir and the target reservoir pressure.

14. The method of claim 11, wherein the compressed air stored in the reservoir is used to perform:

at least one standby operation that is performed constantly during the operation of the machine at a fixed standby pressure;

at least one fixed-pressure auxiliary operation that is performed intermittently during the operation of the machine at a fixed auxiliary pressure; and at least one variable-pressure auxiliary operation that is performed intermittently during the operation of the machine at a variable auxiliary pressure.

15. The method of claim 14, wherein determining the target reservoir pressure comprises selecting the target reservoir pressure as the fixed standby pressure when the fixed-pressure auxiliary operation and the variable-pressure auxiliary operation are inactive.

16. The method of claim 14, wherein determining the target reservoir pressure comprises selecting the target reservoir pressure as a maximum out of the fixed standby pressure and the variable auxiliary pressure plus a fixed margin pressure when the variable-pressure auxiliary operation is active and the fixed-pressure auxiliary operation is inactive.

17. The method of claim 16, wherein determining the target reservoir pressure comprises selecting zero as the target reservoir pressure when an engine of the machine is starting.

18. A machine, comprising:

an internal combustion engine;

an air compressor driven by the internal combustion engine and having an inlet;

an inlet valve configured to regulate a flow of air into the inlet;

an inlet electronic actuator configured to adjust a position of the inlet valve;

a reservoir configured to store compressed air generated by the air compressor;

a reservoir pressure sensor configured to monitor an actual reservoir pressure of the compressed air stored in the reservoir;

an outlet valve configured to variably regulate a flow of the compressed air out of the reservoir, wherein the outlet valve is a butterfly valve;

an outlet electronic actuator configured to adjust a position of the outlet valve; and an electronic control module (ECM) in electronic communication with the reservoir pressure sensor, the inlet electronic actuator, and the outlet electronic actuator, the ECM being configured to:

transmit a positive command to the inlet electronic actuator and the outlet electronic actuator when the actual reservoir pressure is below a target reservoir pressure, the positive command causing the inlet electronic actuator to at least partially open the inlet valve, the positive command causing the outlet electronic actuator to close the outlet valve;

transmit a negative command to the inlet electronic actuator and the outlet electronic actuator when the actual reservoir pressure is above the target reservoir pressure, the negative command causing the inlet electronic actuator to close the inlet valve, the negative command causing the outlet electronic actuator to at least partially open the outlet valve; and wherein the butterfly valve is configured to permit leakage of compressed air when the butterfly valve is closed.

* * * * *